US007614490B2

(12) United States Patent
Milton-Benoit et al.

(10) Patent No.: US 7,614,490 B2
(45) Date of Patent: Nov. 10, 2009

(54) PASSENGER CONVEYOR HANDRAIL HAVING A GRIPPING SURFACE WITH A GENERALLY CIRCULAR CROSS-SECTION

(75) Inventors: John M. Milton-Benoit, West Suffield, CT (US); Mary Ann T. Valk, Glastonbury, CT (US); Bryan R. Siewert, Westbrook, CT (US); Andre Picker, Stadthagen (DE); Matthias Steffen, Kirchbrak (DE); Andreas Stuffel, Bueckeburg (DE); Klaus Seehausen, Niedernwoehren (DE); Knuth Wallbaum, Bochum (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 12/090,489

(22) PCT Filed: Nov. 14, 2005

(86) PCT No.: PCT/US2005/040797

§ 371 (c)(1),
(2), (4) Date: Apr. 17, 2008

(87) PCT Pub. No.: WO2007/055693

PCT Pub. Date: May 18, 2007

(65) Prior Publication Data

US 2008/0202890 A1 Aug. 28, 2008

(51) Int. Cl.
*B66B 23/24* (2006.01)

(52) U.S. Cl. ..... 198/337; 198/335

(58) Field of Classification Search ..... 198/321, 198/335, 337
See application file for complete search history.

(56) References Cited

U.S. PATENT DOCUMENTS 2,628,700 A * 2/1953 Masek ..... 198/335
2,766,868 A * 10/1956 Tilton ..... 198/337
3,778,882 A 12/1973 Cameron et al.
3,842,961 A * 10/1974 Burson ..... 198/337

(Continued)

FOREIGN PATENT DOCUMENTS

JP 06064881 A 3/1994

(Continued)

OTHER PUBLICATIONS

International Search Report and Written Opinion of the International Searching Authority for International application No. PCT/US05/40797 mailed Oct. 3, 2006.

(Continued)

*Primary Examiner*—James R Bidwell
(74) *Attorney, Agent, or Firm*—Carlson, Gaskey & Olds PC

(57) ABSTRACT

A passenger conveyor handrail (30) has a gripping surface (32, 42, 52, 62, 72, 82) with a generally circular cross-section. Disclosed examples include a toothed driven surface (34, 44, 54, 64, 74, 84) that is adapted to be engaged by a toothed driving member (28) for propelling the handrail in a desired direction. Disclosed examples include having the generally circular cross-section extend along an entire length of the handrail (30) corresponding to the closed loop path followed by the handrail during operation of a corresponding passenger conveyor.

18 Claims, 3 Drawing Sheets

U.S. PATENT DOCUMENTS

| | | | | |
|---|---|---|---|---|
| 4,232,776 | A | 11/1980 | Dean | |
| RE32,839 | E | 1/1989 | Saito et al. | |
| 4,889,222 | A | 12/1989 | Kanamori | |
| 4,982,829 | A * | 1/1991 | Johnson et al. | 198/337 |
| 7,243,775 | B2 * | 7/2007 | Novacek et al. | 198/337 |
| 2005/0173224 | A1 * | 8/2005 | Caunce | 198/337 |

FOREIGN PATENT DOCUMENTS

| | | | | |
|---|---|---|---|---|
| WO | WO 89/04410 | * | 5/1989 | 198/337 |

OTHER PUBLICATIONS

International Preliminary Report on Patentability for International application No. PCT/US05/40797 mailed Jul. 24, 2008.

* cited by examiner

PASSENGER CONVEYOR HANDRAIL HAVING A GRIPPING SURFACE WITH A GENERALLY CIRCULAR CROSS-SECTION

FIELD OF THE INVENTION

This invention generally relates to passenger conveyors. More particularly, this invention relates to handrails for passenger conveyors.

DESCRIPTION OF THE RELATED ART

Passenger conveyors such as escalators and moving walkways have proven effective for carrying people between different locations within a variety of structures. Typical arrangements include a plurality of steps that follow a closed loop pathway. When the steps are exposed to passengers, a passenger can ride upon at least one step to be carried in a desired direction. Typical arrangements also include a handrail that moves along with the steps. The handrail allows an individual to stabilize themself while being carried by the passenger conveyor.

Typical handrails are relatively flat and wide. The shape of the typical handrail is dictated by the typical drive mechanism for moving the handrail. Pinching rollers engage inside and outside surfaces on the handrail when it is in the so-called return path of the handrail loop where the handrail is not exposed to be gripped by a passenger. A generally flat surface is required for adequate frictional engagement by the pinching rollers to achieve the desired handrail movement.

The generally flat and wide handrail configuration does not provide a comfortable gripping service for many individuals. People of relatively smaller stature having smaller hands such as children, the elderly and smaller adults, may not be able to exert sufficient gripping force while holding onto a conventional handrail. Typical handrails are about 3.5 inches in width. That size enables only about 25% of the maximum grip strength of the human hand.

A round conveyor handrail would enable a maximum stabilizing force compared to other shapes. A round gripping surface would allow all of the finger and hand segments to contact the handrail. This would spread the load over more hand area, which would minimize discomfort and increase gripping power. One reason why round handrails for passenger conveyors have not been used is that a rounded gripping surface does not present a surface area that can be adequately engaged by a conventional pinching roller driving mechanism for moving the handrail. Another reason why circular passenger conveyor handrails have not been used is that there are additional cost considerations for establishing a circular, cross-sectional profile that are not an issue when using the conventional, flattened design.

One attempt at providing a rounded passenger conveyor handrail is shown in the Japanese patent document JP 06064881. That document discloses an arrangement where a handrail is flattened in the so-called return path but takes on a rounded shape when exposed to be gripped by a passenger. One disadvantage to that arrangement is that rollers used for driving the handrail contact the gripping surfaces, which introduces the same type of wear that pinching rollers introduce on flattened handrail designs. Accordingly, the additional expenses associated with the proposed circular handrail in that document are potentially even more significant because the replacement following wear of the grip surface is even more significant compared to traditional, flattened designs.

It is desirable to provide an improved passenger conveyor handrail. This invention addresses the need for a more comfortable and more universally useable handrail gripping surface that does not suffer from the drawbacks and shortcomings of the arrangements described above.

SUMMARY OF THE INVENTION

An exemplary disclosed embodiment of a passenger conveyor handrail has a gripping surface with a generally circular cross-section. One example includes a driven surface having a plurality of teeth adapted to be engaged by a driving member for propelling the handrail around a closed loop in a desired direction. In another example, the generally circular cross-section remains the same around the entire length of a closed loop followed by the handrail.

A disclosed example includes a gripping surface having an outside dimension that is in a range between around 25 mm (one inch) and about 75 mm (three inches). One disclosed example has an outside dimension in the range from about 38 mm (1.5 inches) to about 51 mm (two inches).

The various features and advantages of this invention will become apparent to those skilled in the art from the following detailed description. The drawings that accompany the detailed description can be briefly described as follows.

DETAILED DESCRIPTION OF THE PREFERRED EMBODIMENTS

Figure 1:
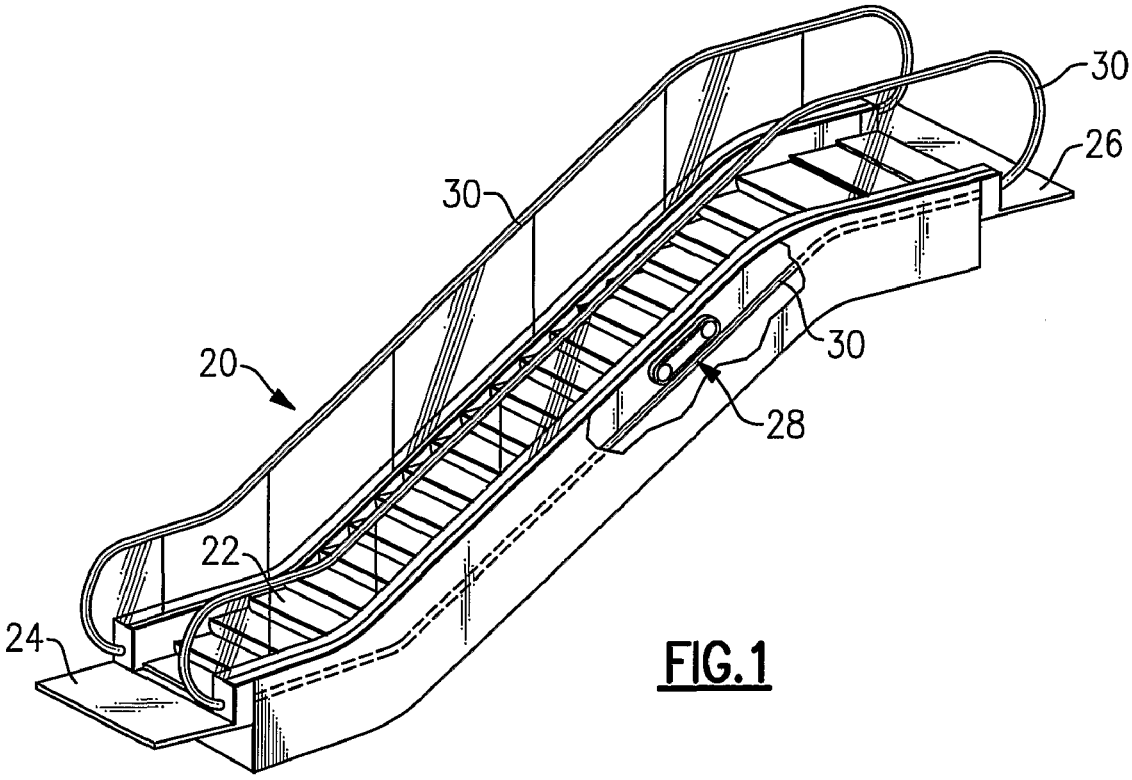
FIG. 1 diagrammatically illustrates an example passenger conveyor.

FIG. 1 shows a passenger conveyor 20 having a plurality of steps 22 that move in a desired direction to carry passengers between landings 24 and 26. The illustrated passenger conveyor 20 is an escalator but this invention is not limited to escalators. Moving walkways or other passenger conveyors could be used.

The illustrated example includes a driving mechanism 28 for propelling a handrail 30 around a closed loop path so that the handrail 30 moves in unison with the steps 22. In one example, the driving mechanism 28 comprises at least one toothed driving member that engages teeth on a driven surface of the handrail 30 for propelling the handrail as desired. One example driving member is a toothed belt. The teeth may be aligned at various angles relative to the direction of movement. Examples include angles in a range from generally parallel (e.g. 0°) to generally perpendicular (e.g., 90°). The example driving mechanism 28 does not require pinching rollers and does not wear the handrail 30.

The handrail 30 has a unique configuration compared to traditional arrangements. The relatively flat gripping surface of conventional handrails for passenger conveyors is greater than 75 mm (three inches) wide. The disclosed example embodiments of a handrail designed according to this invention include a gripping surface that has a generally circular cross section and an outside dimension that is less than three inches.

Figure 2:
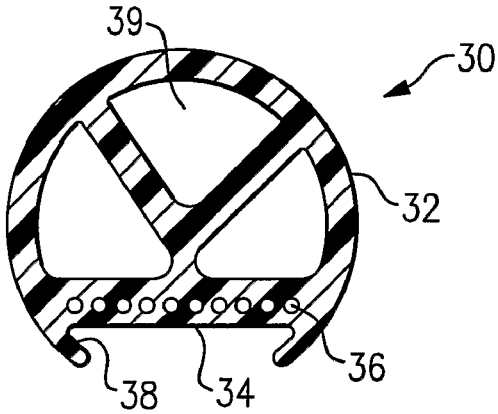
FIG. 2 is a cross-sectional illustration schematically showing one example embodiment of a passenger conveyor handrail.

One example embodiment is shown in FIG. 2 where the handrail gripping surface 32 has a generally circular cross-section. A driven surface 34 includes a plurality of teeth adapted to engage a toothed driving member of the driving mechanism 28. Such a combination avoids requiring frictional engagement of the gripping surface 32 for moving the handrail 30. The circular gripping surface 32 would not work with a standard pinching roller drive without modifications to accommodate the unique shape of the illustrated embodiment.

The illustrated example includes a plurality of reinforcing cords 36 that extend throughout the handrail 30 in a generally known manner. In the example of FIG. 2, the generally circular cross-section of the gripping surface 32 follows a true circular arc along most of the length of the gripping surface 32. The handrail cross-section does not have a completely closed circle although it forms a closed loop as can be appreciated from the drawing.

Oppositely facing guidance-following surfaces 38 are located near the driven surface 34 in this example. The outside dimension (e.g., diameter) of the gripping surface 32 in this example is greater than a spacing between the guidance-following surfaces 38.

As can be appreciated from the illustration, the example of FIG. 2 has a first polymer material forming the gripping surface 32 and at least some of the body of the handrail 30. Spacings 39 within the cross-section in some examples remain empty. In other example, such spacings are filled with another material. Given this description, those skilled in the art will be able to select appropriate materials to meet the needs of their particular situation. Using more than one material or leaving hollow spaces allows for more economical manufacture of the handrail. Using the material desired for the exterior of the gripping surface and the body throughout an entire circular cross-section would introduce additional material cost compared to traditional, flattened handrail designs. This example includes a body structure as schematically shown in FIG. 2 to avoid excessive cost differences between the handrail designed according to the embodiment of FIG. 2 and the traditional, flattened out handrail design. Additionally, the absence of frictional engagement of the gripping surface 32 avoids the marring that plagues traditional handrails. Without that, the disclosed example embodiments avoid costs associated with frequent replacement. This feature evens out any cost difference between the inventive handrail and conventional designs. In some cases, the increased longevity actually provides a cost savings over time.

The generally circular cross section of the gripping surface 32 remains the same along the entire loop path followed by the handrail 30. In other words, the circular shape of the gripping surface 32 extends along an entire length of the handrail 30 around the closed loop of the handrail 30.

Figure 3:
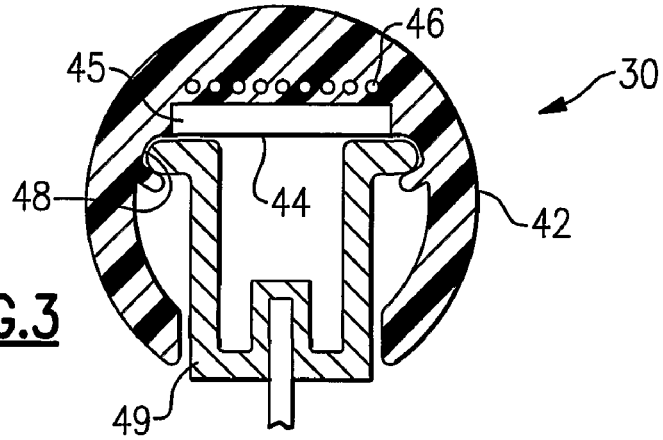
FIG. 3 is a cross-sectional illustration schematically showing another example embodiment of a passenger conveyor handrail.

FIG. 3 schematically shows a cross-section of another example handrail 30. In this example, the gripping surface 42 is generally circular in cross-section. The driven surface 44 includes a plurality of teeth 45 adapted to be engaged by a toothed driving member of the driving mechanism 28. A plurality of reinforcing cords 46 are present within the body of the handrail 30. In this example, guidance-following surfaces 48 are located closer to a top of the gripping surface 42 compared to the example of FIG. 2, for example. A guidance 49 as shown in FIG. 3 is mostly enveloped by the body of the handrail 30 as schematically shown. The example of FIG. 3 may be made from a single material without concerns about excessive material costs.

Figure 4:
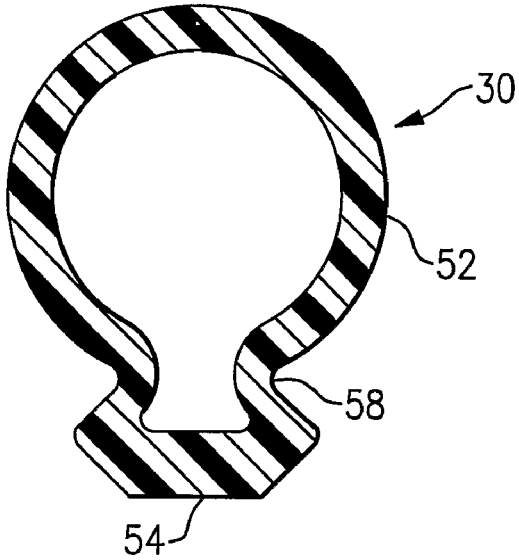
FIG. 4 is a cross-sectional illustration schematically showing another example embodiment of a passenger conveyor handrail.

Another example arrangement is shown in FIG. 4. In this example, the gripping surface 52 has a generally circular cross-section. The driven surface 54 includes a plurality of teeth as the previous examples included. In this example, the guidance-following surfaces 58 face generally outward rather than generally inward as the surfaces 38 and 48 in the examples of FIGS. 2 and 3, respectively. In this example, the generally circular cross-section includes a closed loop as can be appreciated from the illustration.

Figure 5:
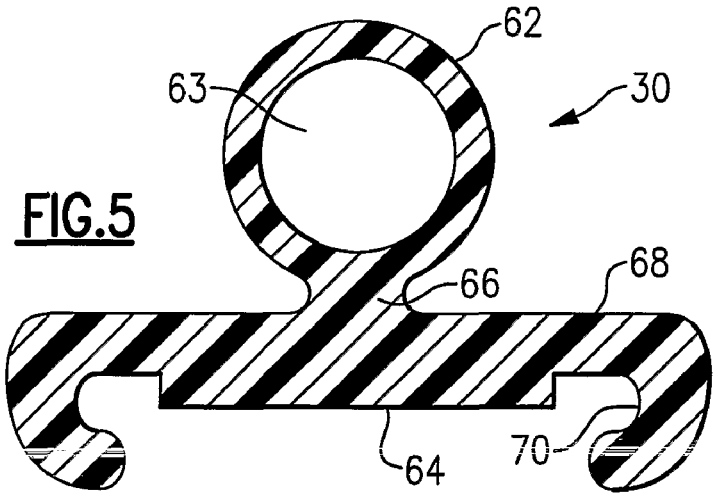
FIG. 5 is a cross-sectional illustration schematically showing another example embodiment of a passenger conveyor handrail.

Another example handrail 30 is shown in FIG. 5. In this example, the gripping surface 62 has a generally circular cross-section. As can be appreciated from the illustration, a central portion 63 of the body of the handrail 30 that establishes the gripping surface 62 may be made from one or more materials.

The illustration in FIG. 5 shows one of the teeth on the driven surface 64 on a generally flattened base 68 that mimics the shape of a traditional handrail. A stem 66 protrudes at least partially away from the base 68 and the gripping surface 62 is supported on the stem 66. Guidance-following surfaces 70 in the example of FIG. 5 can follow along a traditional handrail guidance having conventional dimensions, for example. At the same time, the gripping surface 62 provides an improved gripping surface that fits within a wider range of individuals' hands to provide a more comfortable and more confident riding experience.

Figure 6:
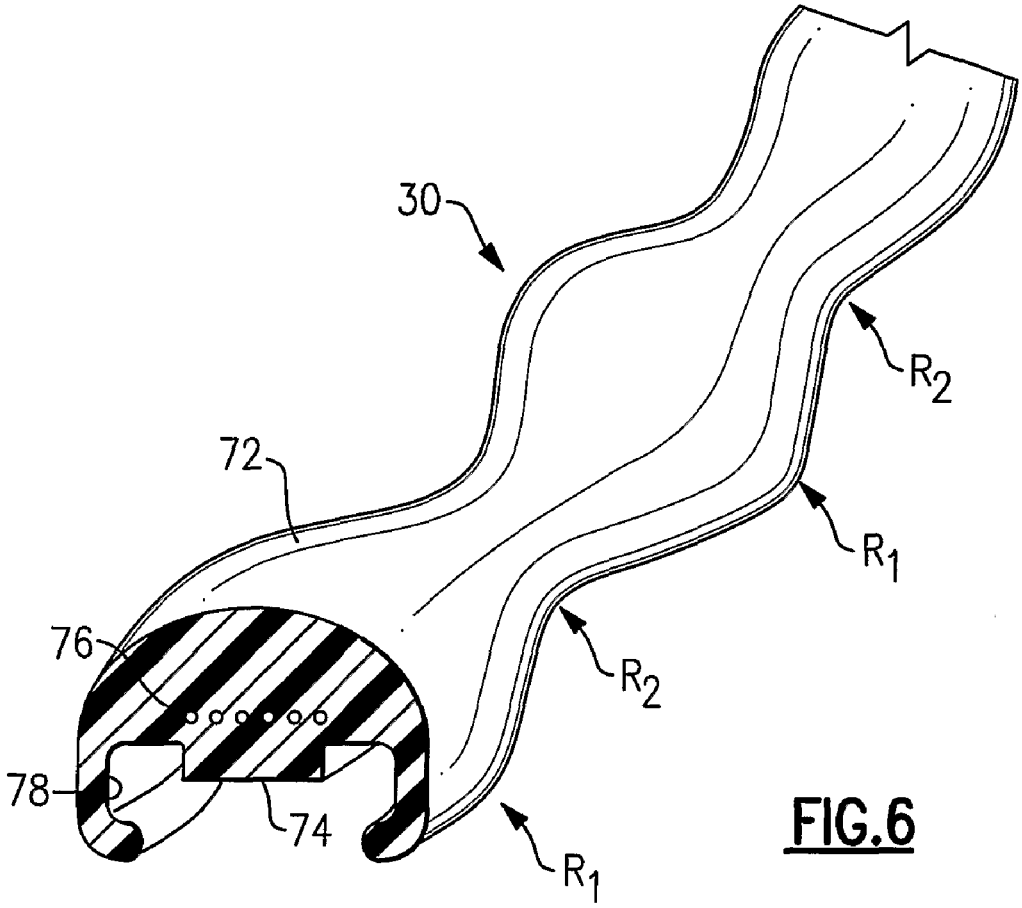
FIG. 6 is a perspective illustration schematically showing another example embodiment of a passenger conveyor handrail.

FIG. 6 shows another example embodiment. In this example, the gripping surface 72 includes undulations along a length of the handrail 30. As can be appreciated from the illustration, some locations along the length include a cross-section with a first outside dimension $R_1$. Other locations include a cross-section having a second, smaller outside dimension $R_2$. The undulating or wavy exterior surface of the gripping surface 72 in this example provides additional comfort and stability for an even wider range of individuals. People with relatively smaller hands, for example, may be more inclined to grip the portions having the smaller outside dimension while people with larger hands may be more comfortable gripping the portions with the larger outside dimension. Another advantage to the example of FIG. 6 is that it provides a feeling of more stability so that an individual's hand will not slide lengthwise along the handrail as easily as it may with a gripping surface that has a constant outside dimension along the entire length of the handrail.

The example of FIG. 6 includes a toothed driven surface 74, reinforcing cords 76 and guidance-following surfaces 78.

Figure 7:
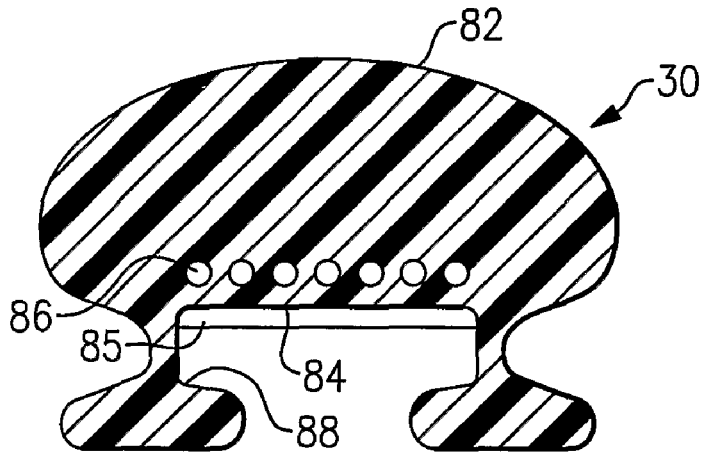
FIG. 7 is a cross-sectional illustration schematically showing another example embodiment of a passenger conveyor handrail.

Another example arrangement is shown in FIG. 7. In this example, the gripping surface 82 has a generally circular cross-section that is elliptical. The outside dimension of the gripping surface 82 in this example varies slightly within the cross-section shown in FIG. 7. As can be appreciated from the drawing, lateral edges of the gripping surface 82 have different radii than a top region of the gripping surface 82 (according to the drawing).

The cross-sectional view taken in FIG. 7 shows at least one tooth 85 on the driven surface 84, reinforcing cords 86 and guidance-following surfaces 88. In this example, an outside dimension of the gripping surface 82 is larger than a spacing between the guidance-following surfaces 88.

Each of the above-described examples may be sized to meet the needs of a particular situation. The disclosed examples each have an aspect ratio which corresponds to the ratio of the gripping surface width (e.g., right to left in the drawings) to height (e.g., top to bottom in the drawings). The aspect ratio in some examples is 1:1. The aspect ratio in other examples is 2:1. One example embodiment has an aspect ratio of almost 3:1. Maintaining an aspect ratio below 3:1 provides enhanced gripability and greater comfort for a wider variety of passengers compared to conventional designs where the aspect ratio is greater than 3:1.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A passenger conveyor handrail, comprising:

a gripping surface having a generally circular cross section that is curvilinear along the entire gripping surface wherein the gripping surface is undulating along a length of the handrail such that the circular cross section has a first dimension at a first location along the length and a second, larger dimension at a second location along the length; and a driven surface having a plurality of teeth adapted to be engaged by a driving member to propel the handrail in a selected direction.

2. The passenger conveyor handrail of claim 1, wherein the handrail forms a closed loop along a length of the handrail and wherein the gripping surface has the circular cross section along the entire closed loop.

3. The passenger conveyor handrail of claim 1, wherein the gripping surface has an outside dimension that is in a range from about 25 mm to about 75 mm.

4. The passenger conveyor handrail of claim 3, wherein the outside dimension is in a range from about 38 mm to about 51 mm.

5. The passenger conveyor handrail of claim 3, wherein the cross section has a radius corresponding to about one-half the outside dimension and the radius is constant around at least one-half of a circumference of the gripping surface.

6. The passenger conveyor handrail of claim 5, wherein the radius is constant around an entire circumference of the gripping surface.

7. The passenger conveyor handrail of claim 1, wherein the circular cross section comprises a portion that is at least partially elliptical.

8. The passenger conveyor handrail of claim 1, comprising oppositely facing guidance-following surfaces associated with the driven surface and wherein the gripping surface has an outside dimension that is greater than a distance between the guidance-following surfaces.

9. The passenger conveyor handrail of claim 1, wherein the cross section comprises a closed loop.

10. A passenger conveyor handrail, comprising:

a gripping surface having a generally circular cross section that is curvilinear alone the entire gripping surface;

a driven surface having a plurality of teeth adapted to be engaged by a driving member to propel the handrail in a selected direction; and oppositely facing guidance-following surfaces associated with the driven surface and wherein the gripping surface has an outside dimension that is less than a distance between the guidance-following surfaces.

11. The passenger conveyor handrail of claim 10, comprising a base, a stem protruding at least partially away from the base and wherein the gripping surface is supported on the stem.

12. A passenger conveyor handrail, comprising:

a body that forms a closed loop along a length of the handrail; and a gripping surface on the body that has a generally circular cross section that extends along the entire length around the closed loop, the cross section is curvilinear along the entire gripping surface, the circular cross section undulates along the length such that the cross section at a first location along the length has a first outside dimension and the cross section at a second, different location along the length has a second, larger outside dimension.

13. A passenger conveyor handrail, comprising:

a body that forms a closed loop along a length of the handrail; and a gripping surface on the body that has a generally circular cross section that extends along the entire length around the closed loop, the cross section is curvilinear along the entire gripping surface; and oppositely facing guidance-following surfaces and wherein the cross section has an outside dimension that is less than a spacing between the guidance-following surfaces.

14. The passenger conveyor handrail of claim 13, wherein the circular cross section is continuous and uninterrupted along the entire length.

15. The passenger conveyor handrail of claim 13, wherein the circular cross section comprises a closed loop.

16. The passenger conveyor handrail of claim 13, wherein the gripping surface has an outside dimension that is in a range from about 25 mm to about 75 mm.

17. The passenger conveyor handrail of claim 13, wherein the outside dimension is in a range from about 38 mm to about 51 mm.

18. The passenger conveyor handrail of claim 13, comprising a driven surface having a plurality of teeth adapted to be engaged by a driving member for propelling the handrail in a desired direction.

* * * * *